US005467897A

United States Patent [19]

Williams

[11] Patent Number: 5,467,897

[45] Date of Patent: Nov. 21, 1995

[54] RESILIENT COLLAPSIBLE TUBE WITH DEVICE FOR PREVENTING TUBE UNROLLING

[76] Inventor: David E. Williams, P.O. Box 60627, San Diego, Calif. 92166

[21] Appl. No.: 427,251

[22] Filed: Apr. 24, 1995

[51] Int. Cl.[6] ..... B65D 35/08

[52] U.S. Cl. ..... 222/107; 206/805

[58] Field of Search ..... 222/99, 103, 107; 132/248; 24/17 B, 17 AP, 546, 482; 206/805; 383/89, 90

[56] References Cited

U.S. PATENT DOCUMENTS

| | | | |
|---|---|---|---|
| 424,411 | 3/1890 | Fielder | 383/90 |
| 1,731,703 | 6/1928 | Bourke . | |
| 3,248,012 | 4/1964 | Adams . | |
| 3,401,837 | 9/1968 | Wiedeman . | |
| 4,807,782 | 2/1989 | Meinerding et al. . | |
| 4,817,823 | 4/1989 | Sparr, Sr. | 222/103 |
| 5,205,438 | 4/1993 | Southard . | |
| 5,344,049 | 9/1994 | MacDonald . | |
| 5,373,968 | 12/1994 | Nelson | 222/107 X |

*Primary Examiner*—Gregory L. Huson
*Attorney, Agent, or Firm*—Lane, Aitken & McCann

[57] ABSTRACT

A resilient collapsible tube for dispensing viscous material has an elastic device for retaining the tube in progressively rolled positions as the contents of the tube are dispensed. The elastic retaining device defines elastic loops extending longitudinally around the tube.

9 Claims, 4 Drawing Sheets

RESILIENT COLLAPSIBLE TUBE WITH DEVICE FOR PREVENTING TUBE UNROLLING

BACKGROUND OF THE INVENTION

The present invention relates to collapsible tubes for containing and dispensing pastes, creams, gels and the like and, more particularly, to resilient collapsible tubes which have a tendency to unroll after being rolled in connection with the dispensing of their contents.

Tubes for containing and dispensing viscous materials, such as toothpaste, have a central dispensing spout and surrounding collar at one end of a resilient body. The other end of the tube body is closed and flat, defining a line. The contents of such tubes are commonly dispensed by squeezing the sides of the tube when a cap is removed from the spout. In order to prevent the contents of the tube from moving into previously emptied portions of the tube rather than toward the spout when the sides are squeezed, the closed end is rolled progressively toward the spout as the contents are dispensed. A problem with resilient collapsible tubes is that the closed end does not stay rolled, but instead unrolls due to the resiliency of the tube.

SUMMARY OF THE INVENTION

By the present invention, a resilient collapsible tube for dispensing pastes, creams, gels and the like has a device for retaining the tube in progressively rolled positions as the contents of the tube are dispensed. More particularly, the retaining device is an elongate elastic member comprising at least one elastic loop extending, under tension, longitudinally of the tube from an end containing a dispensing spout to a closed end. The elastic loop has a relaxed state in which the loop has a length equal to or less than the longitudinal perimeter of the tube in a totally collapsed and rolled condition. Thus, the length of the elastic loop is selected such that the loop is in a strained, tensioned condition when any contents remain in the tube. By this arrangement, the loop prevents the tube from unrolling, regardless how much the tube has been rolled up. The retaining device engages the dispensing spout to prevent the device from slipping off of the end of the tube containing the dispensing spout. In a preferred embodiment of the invention, two loops are formed in one piece with an anchor ring surrounding the dispensing spout. In other embodiments, two of the loops are part of a continuous band having end portions which extend around approximately 180° of the dispensing spout.

BRIEF DESCRIPTION OF THE DRAWING FIGURES

DETAILED DESCRIPTION OF THE PREFERRED EMBODIMENTS

Figure 1:
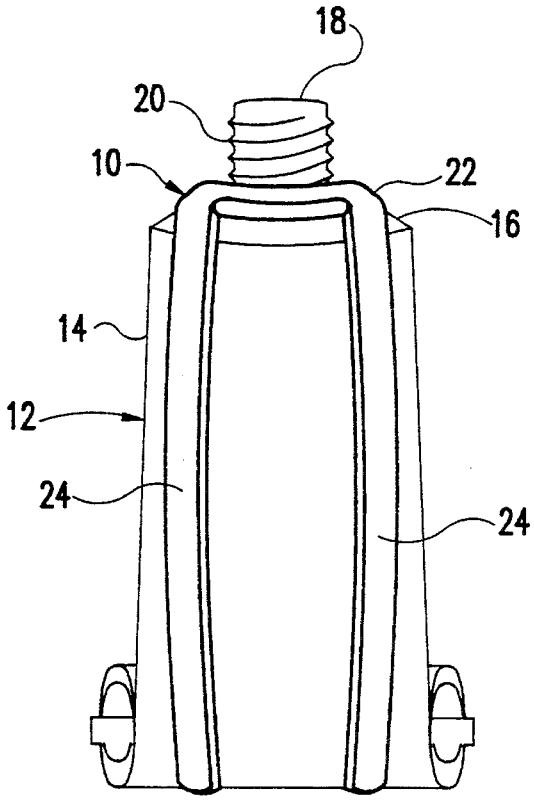
FIG. 1 is a side elevation of a first elastic retaining device according to the invention in place on a collapsible tube.
Figure 3:
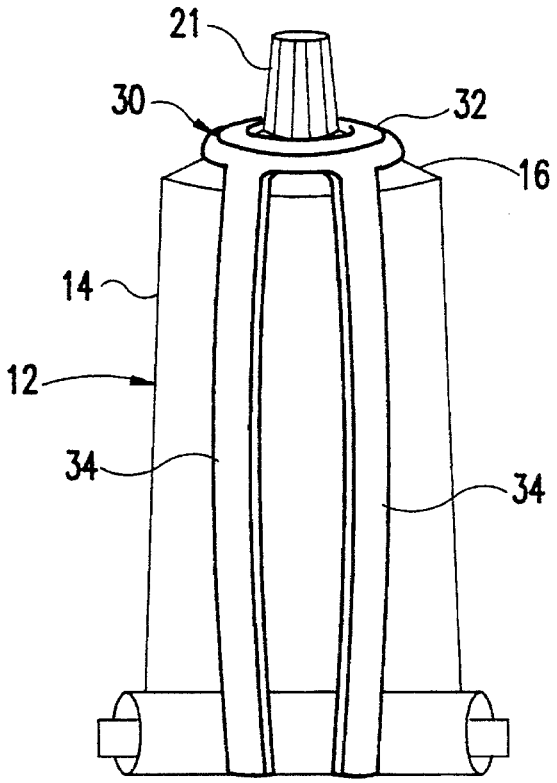
FIG. 3 is a side elevation of a second embodiment of elastic retaining device according to the present invention in place on a collapsible tube.
Figure 4:
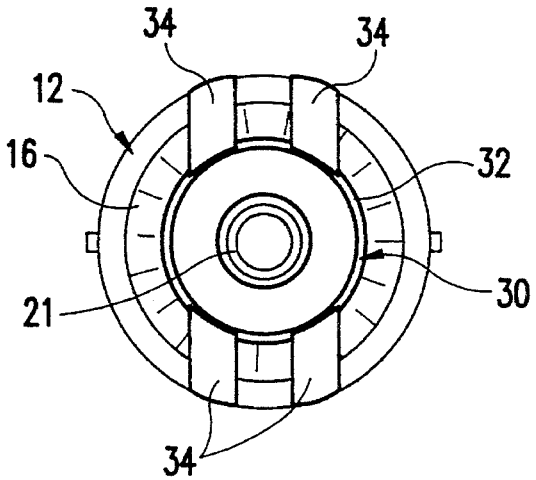
FIG. 4 is a top plan view of the retaining device and tube of FIG. 3.
Figure 5:
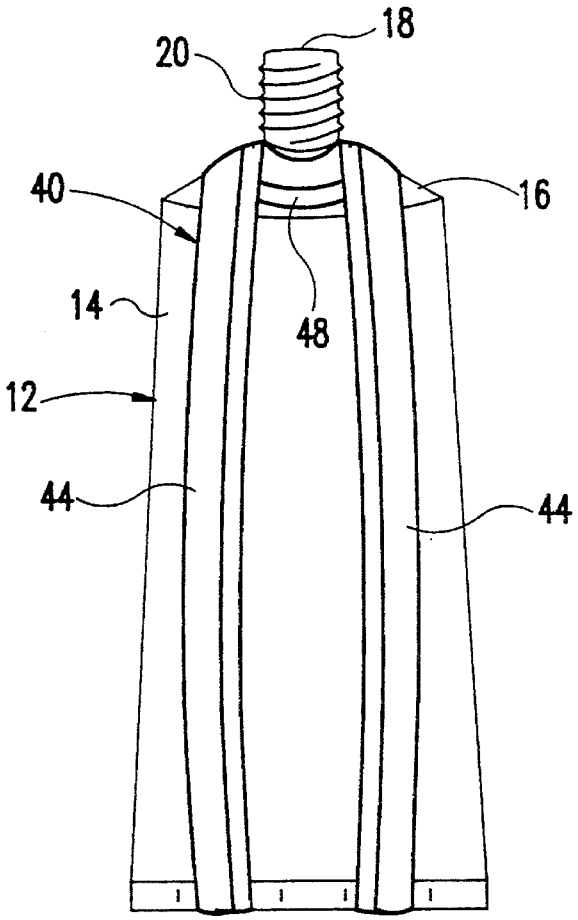
FIG. 5 is a side elevation of a third embodiment of elastic retaining device according to the present invention in place on a collapsible tube.
Figure 6:
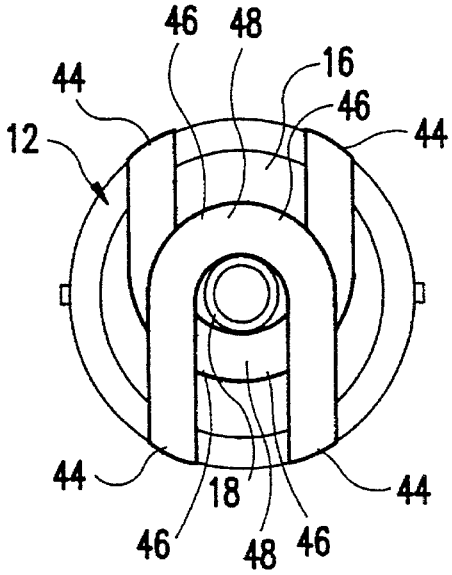
FIG. 6 is a top plan view of the retaining device and tube of FIG. 5.
Figure 7:
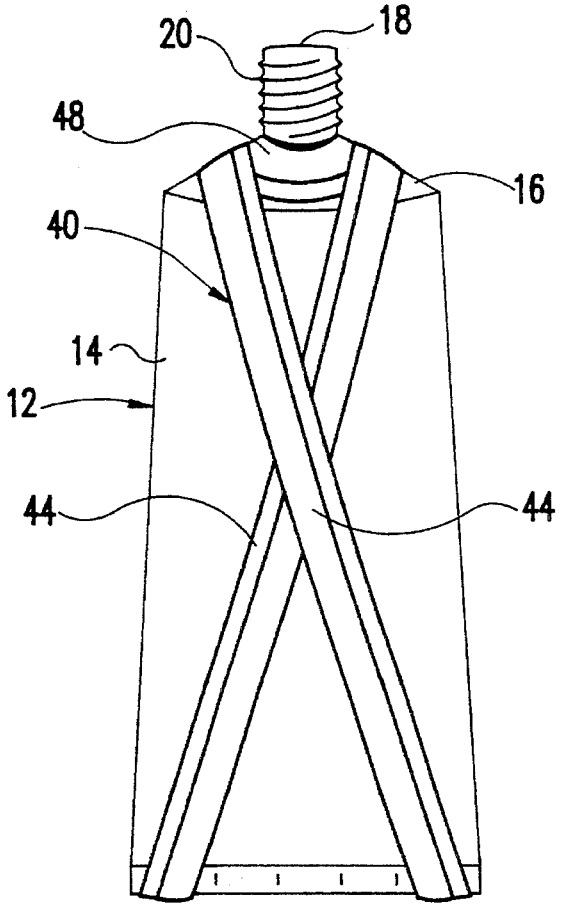
FIG. 7 is a side elevation of a fourth embodiment of elastic retaining device according to the present invention in place on a collapsible tube.

As can be seen from FIG. 1, according to the present invention, a resilient retaining device, which is designated generally by the reference numeral 10, is shown in place on a resilient collapsible tube, which is designated generally by the reference numeral 12. The tube 12 contains a paste, cream, gel or other viscous substance. The tube has an elongate tubular body 14, one end of which is flattened and closed by sealing the end along a line (FIGS. 5 and 7). Opposite to the closed end is an end to which a collar 16 is attached. A dispensing spout 18 projects axially from the collar 16, the dispensing spout having external threads 20 for engagement with internal threads on a cap 21 (FIGS. 3 and 4). Some caps 21 must be removed from the spout 18 in order to permit dispensing of the contents. Other conventional caps (not shown) have a hinged lid which may be pivoted open to permit dispensing of the contents while the cap is in place on the spout 18. The tube 12 is able to be rolled up in the longitudinal direction.

The contents of the tube 12 are dispensed by squeezing the sides of the tube to force the contents through the spout 18. It is common to squeeze the tube at the closed end and, as the contents are emptied, to progressively roll the closed end toward the spout end in order to prevent the contents from moving back into previously emptied areas when the sides of the tube are subsequently squeezed. The resiliency of the tube body 14 tends to unroll the tube, but such unrolling is prevented by the elastic retaining device 10.

Figure 2:
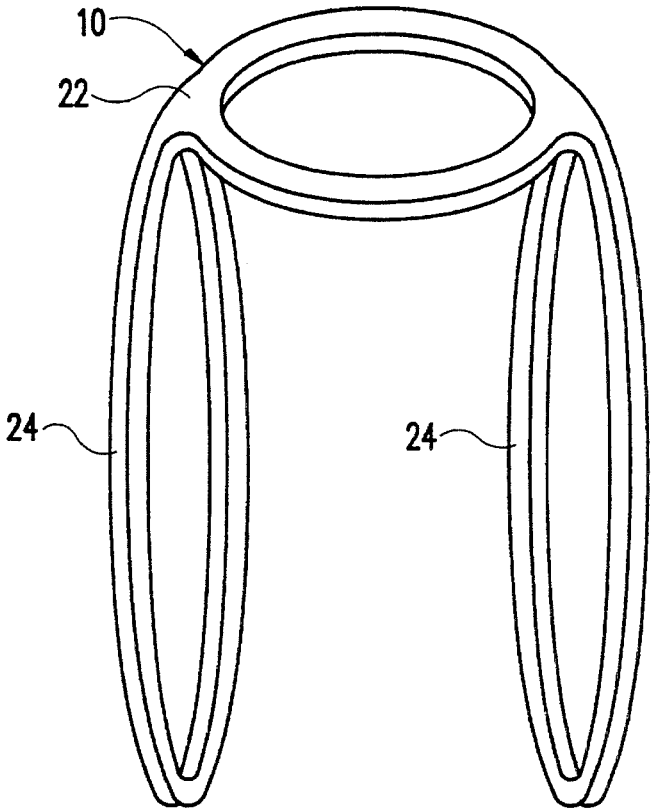
FIG. 2 is a perspective view of the elastic retaining device of FIG. 1.

As can be seen from FIGS. 1 and 2, a first embodiment of the elastic retaining device 10 includes an elastic anchor ring 22 and two elastic, or resilient, loops 24 connected to the anchor ring 22 and extending generally perpendicular to the anchor ring. The anchor ring 22 is positioned between the bottom end of the cap 21 and the collar 16. The loops 24 are connected to the anchor ring 22 at diametrically opposed edges of the anchor ring. The loop 24 and the anchor ring 22 together define one piece. They can be formed in one piece by injection molding. Suitable materials for the elastic retaining device 10 are natural rubber, silicone, Buna-N, neoprene and EPDM.

As can be appreciated from FIG. 1, the anchor ring 22 surrounds and engages the spout 18 of the tube 12. The elastic loops 24 extend longitudinally with respect to the tube 12 from the base of the spout 18 to the closed end of the tube 12. Each loop 24 extends around the collar 16 at the spout end of the tube and around the closed end. In a relaxed state, each elastic loop 24 has a total inside loop length, from a starting point on the loop, completely around the loop and back to the starting point, which is less than the longitudinal perimeter of the tube 12 encompassed by the loop 24 when the tube is in a totally collapsed and rolled condition. Thus, the length of each elastic loop 24 is selected such that the loop is in a strained, tensioned condition when any contents remain in the tube 12. By this arrangement, the loops 24 prevent the tube 12 from unrolling regardless how much the tube has been rolled up. The elasticity of the loops 24 is chosen such that the loops 24 will not cause the contents of the tube to pass through the spout 18 when the cap 22 is removed, even when the tube 12 is full. Factors such as the resiliency of the tube and the viscosity of its contents are considered in determining the elasticity of the loops 24.

As can be seen from FIGS. 3 and 4, an elastic retaining device 30 according to a second embodiment of the present invention includes an elastic anchor ring 32 and two elastic bands 34. Each band 34 is connected to the anchor ring 32 at two points which lie at opposite ends of a chord through a circle defined by the anchor ring. With respect to the center of the anchor ring 32, the angular distance between the two connecting points of one of the elastic loops 34 is greater than the angular distance between adjacent connecting points of the two different elastic loops. The anchor ring 32 is positioned between the bottom end of the cap 21 and the collar 16, when the cap 21 is in position on the spout 18. Other than as described herein and shown in FIGS. 3 and 4, the elastic retaining device 30 according to the second embodiment is constructed the same way and operates in the same way as the elastic retaining device 10 of the first embodiment.

In third and fourth embodiments according to the present invention, as are illustrated in FIGS. 5 and 6 and FIGS. 7 and 8, respectively, an elastic retaining device 40 is one continuous band of elastic material which defines both of the elastic loops 44. As can be appreciated from FIGS. 5 and 6, each elastic loop 44 in the third embodiment extends from the bottom of the tube 12 to the collar 16, adjacent to the spout 18, where extensions 46 of each loop intersect and then merge into corresponding extensions of the other loop. From the points of intersection, the loop extensions 46 extend around and in engagement with the spout 18 at its base. It can be best seen from FIG. 6 that the extensions 46 extending around the spout 18 define smaller loops 48 extending in a direction transverse to the loops 44. The transverse loops 48 resiliently engage the spout 18 at its base, the transverse loops 48 being positioned between the bottom end of the cap 21 and the collar 16 of the tube 12. Other than as described herein, the elastic retaining device 40 of the third embodiment is constructed in the same way and operates in the same way as the elastic retaining member 10 of the first embodiment.

Figure 8:
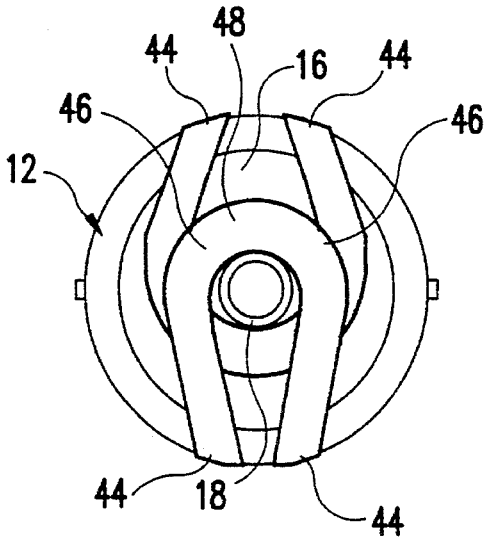
FIG. 8 is a top plan view of the retaining device and tube of FIG. 7.

As can be appreciated from FIGS. 7 and 8, the elastic retaining member 40 of the fourth embodiment is the same as the elastic retaining member 40 of the third embodiment, but is installed on the tube 12 in a different arrangement. More specifically, rather than extend parallel to the longitudinal axis of the tube, each loop 44 is angled from engagement with the spout 18 and the collar 16 on one side of the longitudinal axis of the tube 12 to engagement with the closed end of the tube on the opposite side of the longitudinal axis. Thus, the loops 44 intersect with one another between the closed end and the spout end of the tube 12. In other respects, the elastic retaining device 40 of the fourth embodiment is constructed in the same way and operates in the same way as the elastic retaining device 10 of the first embodiment.

Having thus described the present invention and its preferred embodiments in detail, it will be easily apparent to those skilled in the art that further modifications to the invention may be made without departing from the spirit and scope of the invention as presently claimed. For example the anchor ring can be made of a stronger, less resilient material than the loops, and can be conformable to the shape of the top of the tube under the tension imposed on the anchor by the loops. The anchor ring can be made thinner than the loops.

I claim:

1. In combination, a resilient collapsible tube having a closed first end and a second end defining a dispensing spout, said tube having a longitudinal direction extending between said first and second ends, said tube being collapsible to progressively collapsed positions, and means for retaining the tube in said progressively collapsed positions, said retaining means comprising at least one elastic loop in tension extending around both of said ends of the tube.

2. The combination of claim 1, wherein said tube has a totally collapsed position in which said tube has a minimum perimeter in a plane parallel to said longitudinal direction, said loop in said relaxed condition having a length at least as small as said minimum perimeter of said tube, whereby said loop is under tension when any contents remain in said tube.

3. The combination of claim 1, wherein said retaining means comprises two of said loops.

4. The combination of claim 3, wherein said retaining means further comprises an anchor ring extending around the spout of the tube, and said loops are connected to said anchor ring.

5. The combination of claim 4, wherein said loops and said anchor ring together define one piece.

6. The combination of claim 4, wherein each said loop is connected to the anchor ring in a connection spaced from the connection of the other said loop with the anchor ring.

7. The combination of claim 1, wherein said at least one elastic loop extends around and in engagement with the dispensing spout.

8. The combination of claim 3, wherein said two loops are formed by a single continuous elastic band.

9. The combination of claim 3, wherein said tube is able to be rolled up in said longitudinal direction.

* * * * *